US005300153A

United States Patent [19]

Burtner

[11] Patent Number: 5,300,153

[45] Date of Patent: Apr. 5, 1994

[54] PROCESS FOR CLEANING A NITRIC ACID ABSORPTION COLUMN

[76] Inventor: Gerald G. Burtner, P.O. Box 80786, Baton Rouge, La. 70898

[21] Appl. No.: 16,070

[22] Filed: Feb. 9, 1993

Related U.S. Application Data

[63] Continuation of Ser. No. 682,102, Apr. 5, 1991, Pat. No. 5,213,623.

[51] Int. Cl.[5] ..... B08B 9/04

[52] U.S. Cl. ..... 134/8; 134/22.11; 134/22.12; 134/24

[58] Field of Search ..... 134/7, 8, 22.11, 22.12, 134/24, 34, 166 R; 15/104.061

[56] References Cited

U.S. PATENT DOCUMENTS

| | | | |
|---|---|---|---|
| 3,531,813 | 9/1968 | Hurst | 15/104.062 |
| 4,657,596 | 4/1987 | Murray et al. | 134/10 X |
| 4,825,498 | 5/1989 | Rankin | 15/104.061 |
| 4,848,380 | 7/1989 | Francis et al. | 134/22.12 |
| 5,213,623 | 5/1993 | Burtner | 134/8 |

*Primary Examiner*—R. Bruce Breneman
*Assistant Examiner*—Saeed T. Chaudhry
*Attorney, Agent, or Firm*—William David Kiesel; Robert C. Tucker; Warner J. Delaune, Jr.

[57] ABSTRACT

A method of cleaning a nitric acid absorption column is provided comprising: (a) cleaning its absorption column coil having an access port and an exit port by inserting a pig in the access port; maintaining pressure against the pig sufficient to force the pig through the coil; and capturing the pig after it passes through the exit port, and (b) cleaning the cooling fluid supply manifold headers and header hoses and the cooling fluid return manifold headers and header hoses by operatively connecting a valve means to a high pressure water or similar fluid supply to control the amount of high pressure water or similar fluid flowing through the valve means and into a flexible hose which has been operatively connected to the valve means to receive the high pressure water, operatively attaching a hollow tube having a nozzle provided with reverse direction orifices to the opposite end of the flexible hose to receive the high pressure water from the flexible hose and to allow the high pressure water to exit from the reverse direction orifices, inserting the nozzle into the header or header hose until it emerges into the manifold cavity, opening the valve means to allow high pressure water to flow out said reverse direction orifices, and pulling the nozzle out of the header or header hose.

10 Claims, 5 Drawing Sheets

PROCESS FOR CLEANING A NITRIC ACID ABSORPTION COLUMN

This is a continuation of copending application Ser. No. 07/682,102 filed Apr. 5, 1991, now U.S. Pat. No. 5,213,623.

BACKGROUND OF THE INVENTION

1. Field of the Invention

This invention relates in general to methods for cleaning coils and header columns in an absorption column, and more particularly, to methods f or cleaning a nitric acid absorption column.

2. Prior Art

In many industrial processes it is desirable to treat a dilute (20%) nitric acid stream to form a more concentrate (typically 59%, 70%, or 92%) nitric acid stream. This is accomplished through the use of an absorption column. Typically, such columns may be up to 200 feet tall and 10–15 feet in diameter. There will be a sparger assembly at the top of the column to introduce the dilute nitric acid, and a sparger assembly at the bottom of the column to introduce nitrous gases. Inside the column will be a series of bubble cap or sieve trays wherein each tray holds multiple rows of coils and within each row are multitudes of three-quarter inch or one and one-quarter inch inside diameter cooling coils. The number of coils per tray will vary depending on the cooling requirements of the column, and may depend on such parameters as feed stock and column design. Typically, there are 4–36 coils per tray, and 24–48 trays in a column. These coils are connected at one end to a water source such as a water cooling tower and enter from outside the column via a cooling tower vertical inlet header having horizontal branches, and are positioned in the trays and then exit back to the outside of the column to a return header, and then finally back to the water cooling tower to complete the water circulation flow. Water is the usual cooling fluid circulated in the coils, although chilled brine may be used, particularly in the upper section of the column.

Because the efficiency of the absorption tower depends upon control of the heat of reaction taking place within the column it is important that one can control the amount of water circulating within the coils. However, several problems occur which can restrict the control of water flowing through the coils. It is not uncommon that wood splinters and other solid particles in the water cooling tower enter the water stream circulating within the coils. When this happens it is possible f or a coil or coils to become partially or completely plugged. In addition the coils may develop leaks which allow nitric acid to enter the water stream and flow back to the water tower. When this occurs it is usual to add a base or alkaline material to the water to reduce the effects of the acid to other parts of the water cooling tower. These chemicals in turn result in the formation of precipitates such as iron that will coagulate and eventually partially or completely plug various coils within the absorption tower.

After a period of time it becomes necessary to repair leaking coils, as well as to clean out the plugged coils. The two most common methods of cleaning out the plugged coils include (i) accessing the coils one at a time from outside of the column and trying to blow air or fluid through the coil under sufficient pressure to force out any material causing a blockage, and (ii) acid treating the coils by pumping acid through all of the coils at one time. Both methods have significant drawbacks. First, is that both require a shutdown of the absorption tower for long periods of time while the repairs and cleaning are being carried out. In an industrial environment this effectively shuts down a plant or major process operations of a plant. Because there are so many coils in parallel (300–800) and because of the many bends in the coils and the distance the entrapped air must flow to be displaced from the coils, high pressure is required to flush acid through the coils with no assurance of opening the plugged coils. Pumping through all the tubes at once results in the necessity of using large pumps, and creates a dangerous operation because of the possibility that connecting hoses, particularly if they are old hoses, may be blown off by the pressure. As a result of feeding so many coils in parallel, it is common that after an attempted acid cleaning, a substantial amount of acidic sludge may accidentally remain in the coils which then may be difficult to remove.

Testing for leaks on stream creates additional problems, not the least of which is that in many cases it is not readily apparent where a particular leaking coil is located, nor where its outlet exits the column. Thus, to plug-off a particular leaking coil requires that one first determine where the particular coil exits. This can be a very time consuming task when the tower is on-stream considering that there may be up to 36 coils per tray, and as many as 48 trays per column.

Yet another problem has been discovered by applicant and that is the water supply manifold headers and hoses and the water return manifold headers and hoses may also become plugged. Unless these headers and hoses are unplugged, water or other cooling liquid can not efficiently circulate through the coils in the absorption column.

OBJECTS AND SUMMARY OF THE INVENTION

Therefore one object of this invention is to provide a reliable method for cleaning a nitric acid absorption column.

Another object of this invention is to provide a hydrostatic test method for determining if an absorption column coil has a leak.

Still another object of this invention is to provide a method for cleaning absorption column coils which does not require the shut down of the use of the absorption column during the cleaning operation.

A still further object of this invention is to provide a method for determining if an absorption column coil has a leak which does not require the shut down of the use of the absorption column during the check.

Another further object of this invention is to provide a method for quickly and safely cleaning absorption column coils or for determining if any of the coils has a leak.

A still further object of this invention is to provide a method for quickly and safely cleaning the absorption column water supply manifold, header, and header hoses and water return manifold, header, and header hoses.

Other objects and advantages of the invention will become apparent from the ensuing descriptions of the invention.

Accordingly, a method of cleaning an absorption column is provided comprising: (a) cleaning its absorption column coil having an access port and an exit port by inserting a pig in the access port; maintaining pressure against the pig sufficient to force the pig through the coil; and capturing the pig after it passes through the exit port, and (b) cleaning the cooling fluid supply manifold headers and header hoses and the cooling fluid return manifold headers and header hoses by operatively connecting a valve means to a high pressure water or similar fluid supply to control the amount of high pressure water or similar fluid flowing through the valve means and into a flexible hose which has been operatively connected to the valve means to receive the high pressure water, operatively attaching a hollow tube having a nozzle provided with reverse direction orifices to the opposite end of the flexible hose to receive the high pressure water from the flexible hose and to allow the high pressure water to exit from the reverse direction orifices, inserting the nozzle into the header or header hose until it emerges into the manifold cavity, opening the valve means to allow high pressure water to flow out said reverse direction orifices, and pulling the nozzle out of the header or header hose.

PREFERRED EMBODIMENTS OF THE INVENTION

Figure 1:
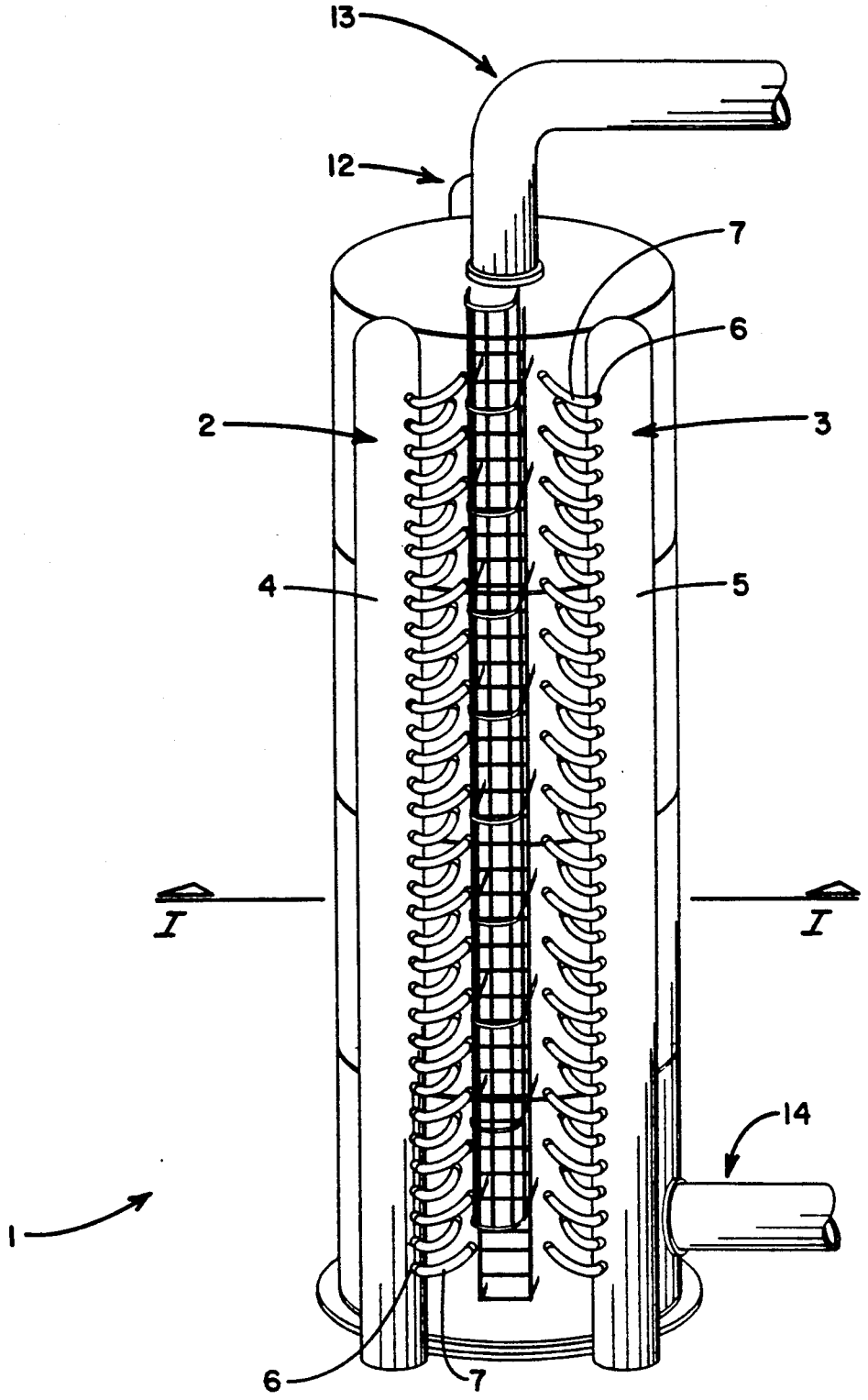
FIG. 1 is a three-dimensional view of one embodiment of a conventional absorption column.
Figure 2:
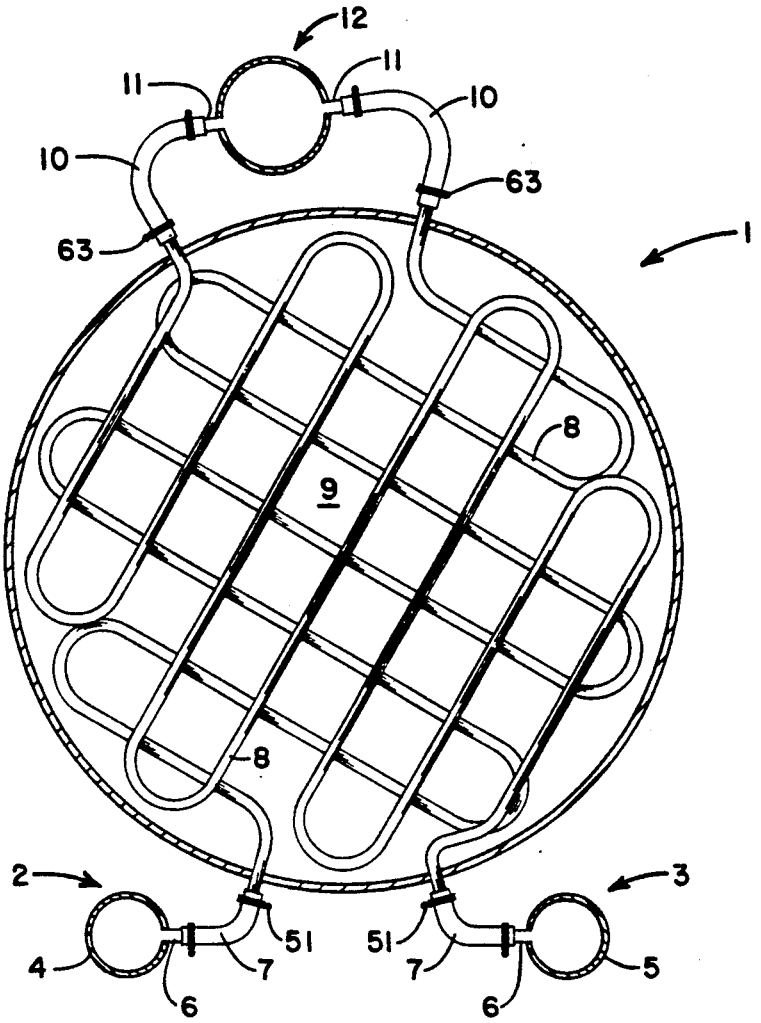
FIG. 2 is a cross-sectional view taken along line I—I of FIG. 1 disclosing the positioning of only two of the many coils in a typical sieve tray.

Referring to FIGS. 1 and 2 a conventional absorption column 1 is illustrated having fluid supply manifolds 2 and 3 which are connected at one end (not shown) to receive water from a water source. Protruding from the outside surfaces 4 and 5 of manifolds 2 and 3, respectively are headers 6 to which hoses 7 are connected. Hoses 7 are in turn connected to coils 8 that are configured in trays 9 located inside absorption column 1. Coils 8 exit outside absorption column 1 where they are connected to a second set of hoses 10 which in turn are connected to a second set of headers 11 protruding from fluid return manifold 12.

Absorption column 1 has fluid conduit 13 through which dilute nitric acid can be introduced to the top section of absorption column 1, typically through a sparger assembly (not shown), and fluid conduit 14 through which nitrous gases can be introduced to the bottom section of absorption column 1, typically through a second sparger assembly (not shown).

In operation water or other cooling fluid will be pumped from the water source to the fluid supply manifolds 2 and 3, and into coils 8 by way of hoses 10. The water then exits coils 8 through hoses 10 and is returned to the water source (e.g., a cooling tower) by way of the fluid return manifold 12 and a fluid return conduit operatively connecting the manifold 12 to the cooling tower. While the water is circulating through coils 8 dilute nitric acid is sprayed from the sparger located in the top section of the column 1 and nitrous gases sprayed from the sparger located in the bottom section of the column 1. The mixing of the dilute nitric acid and nitrous gases within the column 1 causes a chemical reaction producing a more concentrated nitric acid and heat. The concentrated nitric acid is collected at the bottom of the column 1 and sent to storage by conventional means not shown. The heat generated is absorbed by the circulating water and thus removed from column 1. For the process to operate efficiently it is necessary that the reaction conditions, including the temperature within the column, be controlled. When a sufficient number of coils 8 become plugged or begin leaking as a result of corrosion, then it is not possible to extract sufficient heat from within the column 1 during the reaction.

To alleviate this problem it is desirable to unplug the plugged coils and replace or seal those which are leaking. The apparatus and methods of this invention are designed to help accomplish either or both of these functions.

Figure 3:
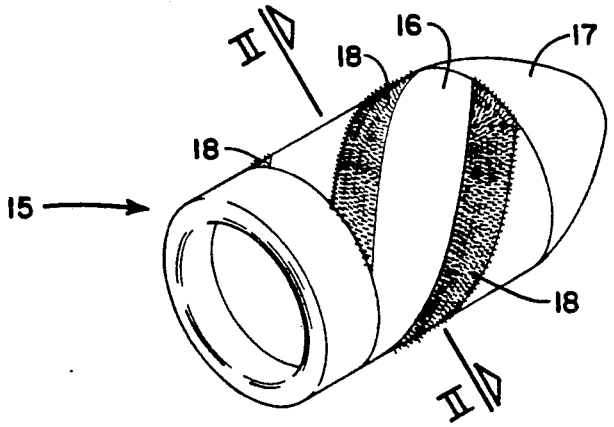
FIG. 3 is a perspective view of one preferred embodiment of the pig used with this invention.
Figure 4:
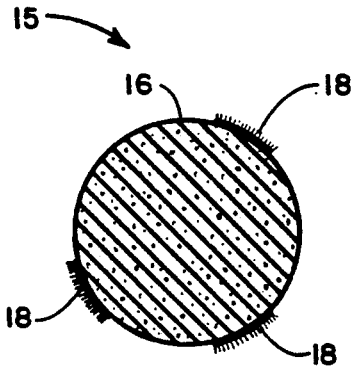
FIG. 4 is a cross-sectional view taken along lines II—II of FIG. 3 of the pig.

In a first aspect of this invention a specially designed pig is utilized in the unplugging of coils S. Referring to FIGS. 3 and 4, pig 15 comprises a cylindrical shaped body 16 constructed of polyurethane foam or material having similar compressibility and lateral expansion characteristics. In a more preferred embodiment the nose section 17 of body 16 will be rounded to aid in movement through coils 8. Bands 18 of wire bristles are glued or otherwise fixedly attached about the outer surface of body 16, preferably in a spiral pattern as shown. In this preferred configuration the lateral expansion of the polyurethane foam and the positioning of the bands 18 minimizes the removal of the wire bristles as pig 15 is forced through coil 8. It is further preferred that the outside diameter of pig 15 be approximately one-sixteenth of one inch greater than the inside diameter of the coil 8 being cleaned.

Figure 5:
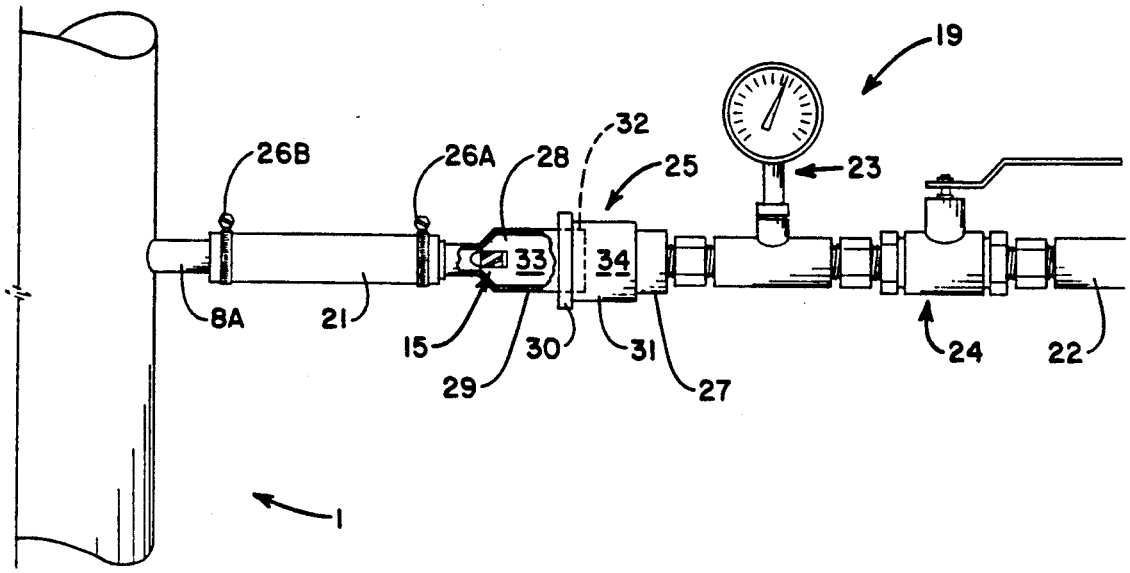
FIG. 5 is a perspective view of one preferred embodiment of the launching assembly of this invention.
Figure 6:
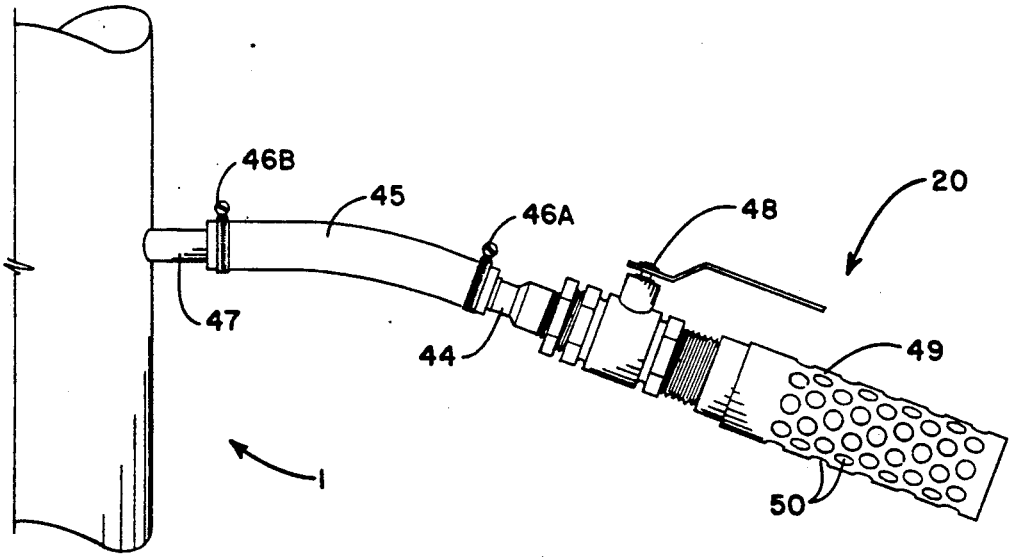
FIG. 6 is a perspective view of another preferred embodiment of the pig catcher assembly utilized to assist with hydrostatic coil tests, as well as coil cleaning.

In addition to pig 15 one utilizes a pig launcher assembly 19 such as shown in FIG. 5 which is connectable to a conventional high pressure water source (not shown), and a pig receiver assembly 20 such as shown in FIG. 6. Referring now to FIG. 5, pig launcher assembly 19 comprises flexible hosing 21 that attaches at one end to the header 6 for the coil 8 being cleaned. The other end of hosing 21 is connected to high pressure water line 22 having a pressure gauge 23 operatively mounted thereon to measure and visually indicate the water pressure in hosing 21. Operatively connected between pressure gauge 23 and high pressure water line 22 is cut-off valve 24 which can cut-off water flow to flexible hosing 21 when desired. Both pressure gauge 23 and cut-off valve 24 may be of any conventional construction which permits flow of water from high pressure water line 22 to flexible hosing 21.

In the embodiment of pig launcher assembly 19 shown in FIG. 5 a swage 25 is operatively connected by gear clamps 26 to flexible hosing 21 and pressure gauge tubing 27 to permit high pressure water to flow from tubing 27 through passageway 28 of launcher 25 to hosing 21. Swage 25 comprises a forward section 29 having a threaded hammer union 30 attached to the end facing the rear section 31 having a threaded end 32 to matingly connect to hammer union 30 to form a seal through which the high pressure water will not leak. Both sections have cavities 33 and 34, respectively, that form passageway 28 when the two section have been connected. Passageway 28 is of sufficient inside diameter and shape to permit pig 15 to be positioned in passageway 28 and be forced by the high water pressure into hosing 21.

In an alternate embodiment swage 25 is removed and hose 21 is connected directly to pressure gauge tubing 27. Gear clamp 26A is then tightened to fix hose 21 to tubing 27 to prevent water leakage. In operation pig 15 is first placed at least partially in the protruding end 8A of coil 8. Hose 21 is then fitted over both pig 15 and the protruding end 8A of coil 8. Gear clamp 26B is then tightened to fix hose 21 onto coil end 8A, and then the operation proceeds the same as if a swage 25 was in place.

If it is desired to permit continuous pump discharge of the water during the testing procedure a dual relief valve assembly 35 (See FIG. 7) can be used. Assembly 35 comprises tubing 36 which connects at one end 37 to manifold 38 connected to high pressure pump 39 and permits water flow to both relief valves 40 and 41. One outlet 42 of manifold 38 is operatively attached to cut-off valve 24 by hose 22 to permit water flow thereto. A second outlet 43 is operatively connected to one end of tubing 36 to permit high pressure water to flow to both relief valves 40 and 41. Attached to relief valve 40 is by-pass hose 44 that permits high pressure water to flow through relief valve 40 back to the water source. Relief valve 40 is a 400 psig or greater relief valve. In a preferred embodiment relief valve 40 is a 1,000 psig relief valve and relief valve 41 is a 1,500 psig relief valve.

Referring now to FIG. 6 a preferred embodiment of pig receiver assembly 20 is illustrated which can be used in both coil cleaning and leak detection procedures. Assembly 20 comprises nipple 44 to which flexible hose 45 is operatively attached by gear clamp 46A at one end and attached by gear clamp 46B at its other end to exit header 47 of the coil being cleaned and/or leak tested to permit both pig 15 and the high pressure water to flow through nipple 44, cut-off valve 48 (when opened) and into perforated receiver 49. The perforations 50 are sized to permit the water to flow through so as not to build up any back pressure, but not sufficiently large to permit pig 15 to pass through them.

Figure 7:
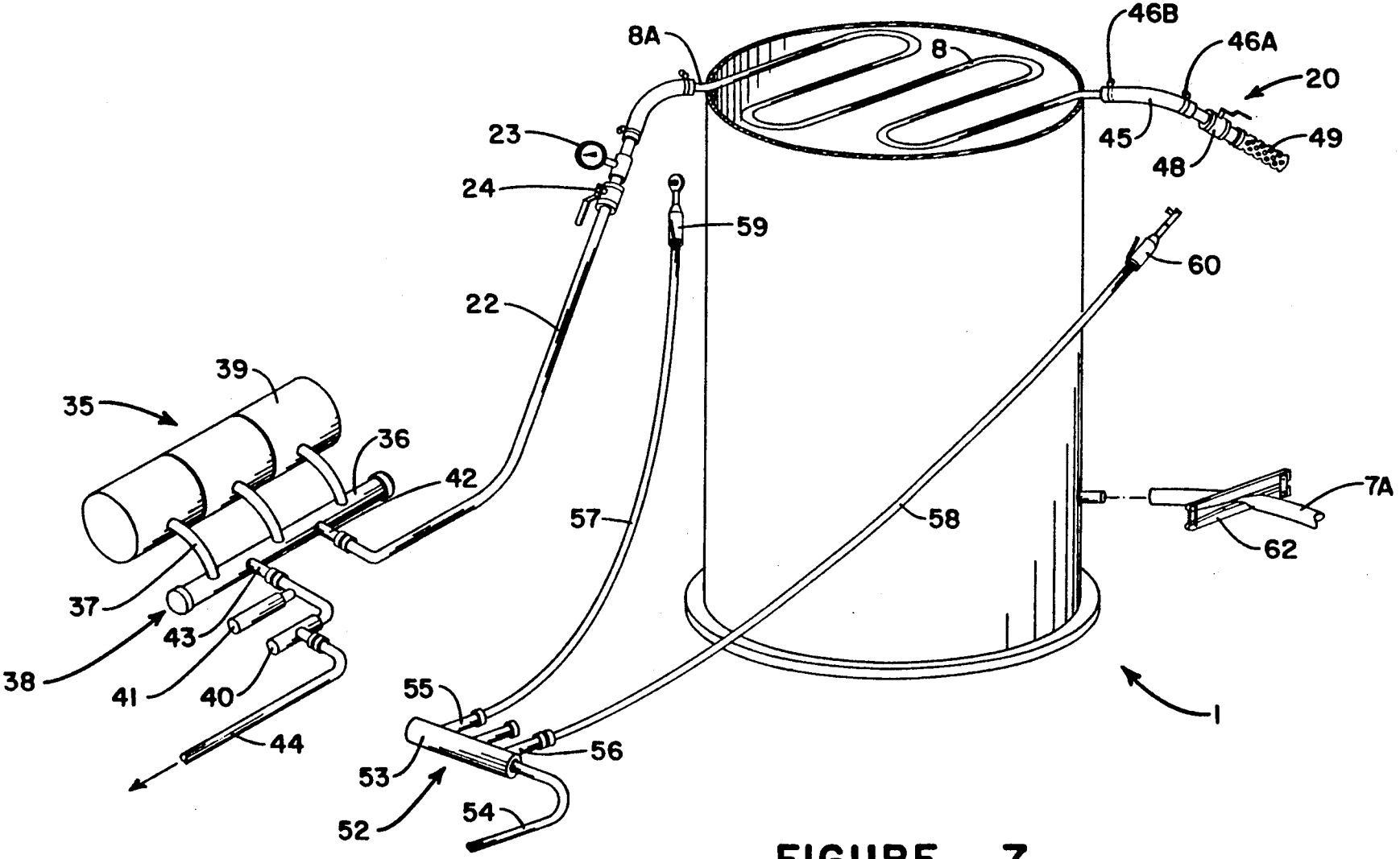
FIG. 7 is a perspective view of still another preferred embodiment of the launching assembly utilized with dual relief valves which permit the continuous pump discharge and which illustrates the use of air rachet wrenches for loosening and tightening the gear clamps utilized in connecting the flexible hosing used in the procedure.

When one desires to both hydrostatic test for leaks in a coil 8 and then clean the coil the apparatus of this invention is first connected to coil 8 in the following manner (See FIGS. 2 and 7). Water flowing to the particular coil being tested is diverted to other coils by the use of alligator clamp 62 to cut off the water supply flowing through the supply hose 7A that provides water to the particular coil being tested and/or cleaned, or the flow stopped to all coils. The clamps fixing hose 7A to coil end 8A is detached from coil end 8A. In a preferred embodiment an air ratchet wrench assembly 52 is utilized to quickly loosen the bolts holding clamps 51 in place. More preferably, assembly 52 comprises a manifold 53 having an entry port 54 to receive air and at least two exit ports 55 and 56 to which are attached air hoses 57 and 58, respectively. Operatively attached to the opposite end of each air hose 57, 58 is an air ratchet wrench 59 and 60, respectively. Air hoses 57 and 58 are preferably of sufficient length to allow simultaneous attachment to the bolts of clamp 51 and the bolts of clamp 63 so that hoses 7 and 10, respectively, can be removed at the same time.

Pig 15 is now positioned for insertion into coil 8. If pig launcher assembly 19 without swage 25 is used, this is accomplished by twisting pig 15 partially into header 6. If pig launcher assembly 19 illustrated in FIG. 5 is used, pig 15 is first placed in cavity 33 and swage 25 assembled together by screwing hammer union 30 on threaded end 32. Flexible hosing 21 is then pushed over and sealingly clamped to header 6 to prevent water leakage during the cleaning operation. During this procedure cut-off valve 24 is closed to prevent any water flowing into header 6 or cavity 33. Water is pumped under pressure by pump 39 through line 22 to valve 24. It is preferred that the pressure at valve 24 be between 50 and 500 psig, more preferably about 100 psig initially. Valve 24 is opened subjecting pig 15 to the high pressure water which forces pig 15 to pass through coil 8. The wire bristle bands 18 will scrape off accumulated scale and similar material from the inside surface of coil 8, thus removing constrictions which are restricting the water flow through coil 8.

Already attached to return header 11 is pig receiver assembly 20 whose cut-off valve 48 is open to allow pig 15 and the high pressure water to exit coil 8. The water passes through perforations 50 while the pig 15 is retained in receiver 49. This procedure may be repeated if desired. In the event that pig 15 should become stuck in coil 8, cut-off valve 24 is closed and flexible hosing 21 and 45 are reversed so that when cut-off valve is opened high pressure water is forced through coil 8 in the opposite direction thus forcing pig 15 back out the way it came.

In another embodiment if hard acid-soluble scale is encountered, coils 8 are connected together in series by hosing clamped to the supply headers 6 and return headers 11. Liquid acid or acid mist from an acid source is then circulated through coils 8 to pre-soften the scale before pig 15 is forced through coils 8. When the acid exits the last coil 8 it is transferred back to the acid source to avoid any environmental problems.

If after pig 15 has been caught by receiver 49, one also desires to hydrostatically pressure test coils 8 to determine if there are any leaks, then cut-off valve 48 is closed. One then reads the pressure on pressure gauge 23 and then closes cut-off valve 24. During a predetermined period of time one periodically observes the pressure readings to see if there has been any drop in the pressure. If so, this is an indication that the coil is leaking. If the leak is severe, then the coil can be replaced and taken out of the water flow system by clamping hoses 7 and 11 to and from that particular leaking coil.

If desired one could first test for leaks in a coil, and then if none found one could clean the coil following the procedures set forth above.

Figure 8:
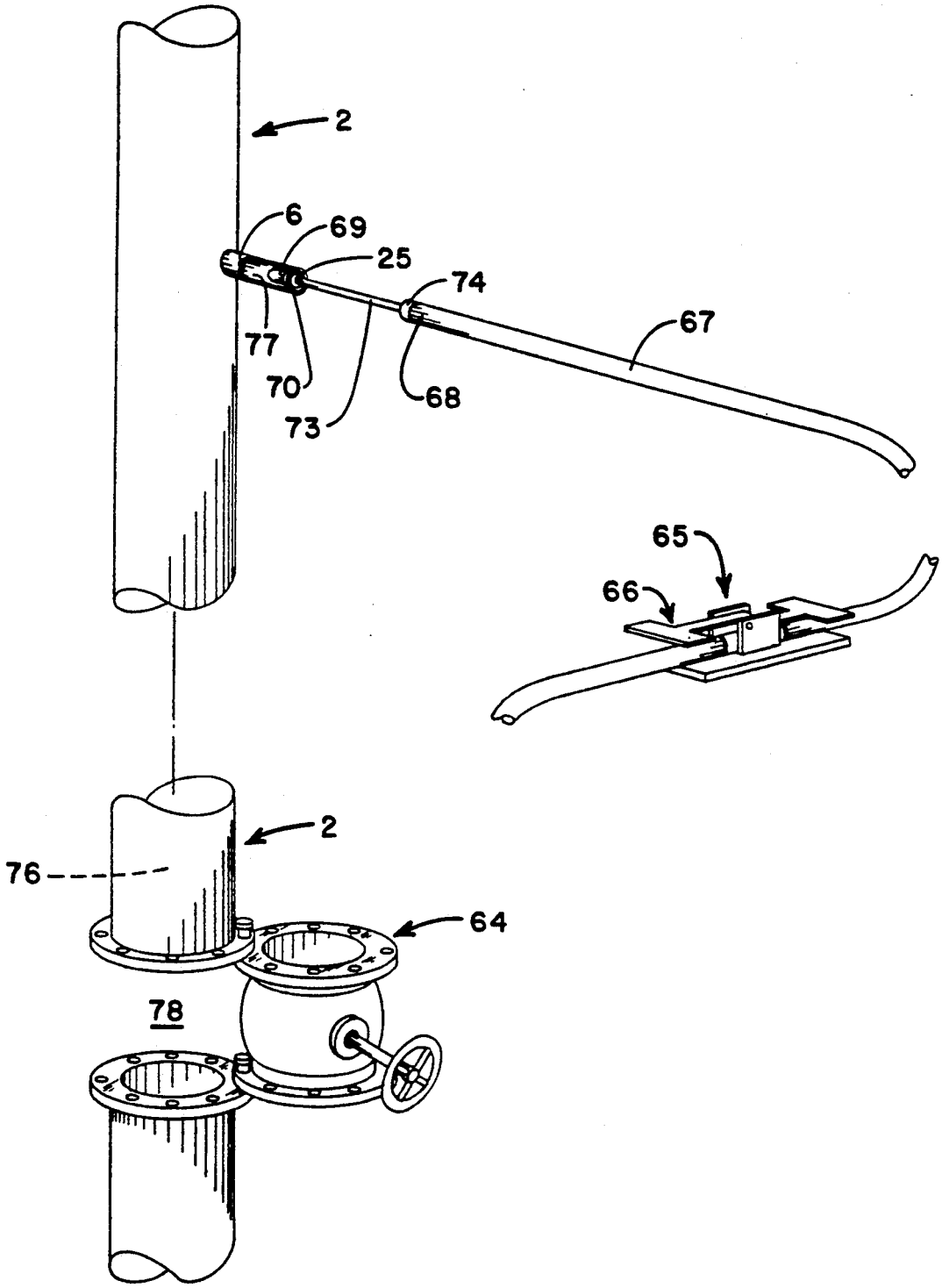
FIG. 8 is a perspective view of a preferred embodiment of the assembly utilized to unplug the vertical manifold, the manifold headers and the header hoses and having a foot control valve means.

It has been discovered that one of the problem with absorption columns has been the clogging of the manifold cavity 76, and more importantly the headers 6 and the hoses 7 connecting the headers to coils 8. Unless these are also unplugged and cleaned the efficiency of the absorption column will be negatively effected. Referring now to FIG. 8, preferred embodiments of apparatus which can be used to solve this problem is shown.

A partial cutaway of the vertical cooling fluid supply manifold 2 is illustrated wherein hose 7 attached to one end of header 6 has been disconnected from the coil 8 to which it had been attached. At the lower end of manifold 2 cooling fluid control valve 64 is shown by the dotted lines in a "rolled-out" position. The apparatus and methods described to unplug and clean manifold 2 and its headers 6 and the attached hose 7 could also be used to unplug and clean manifolds 3 and 12 and their headers 6, 11, respectively, and their hoses 7, 10, respectively.

To clean manifold 2 a valve 65 having a foot operated shut-off assembly 66 is attached at one end to a high pressure water source. To its opposite end a flexible hose 67 is operatively attached to receive the high pressure water. At end 68 of hose 67 is nozzle 69 having reverse direction orifices 70 positioned to direct the high pressure water downward and outward from hose 67 and in a direction to cause the high pressure water to strike the interior wall surface 72 forming the manifold cavity 76. In operation cooling fluid to manifold 2 is shut-off and valve 64 is pivoted on is bolts 71 in a position to allow nozzle 69 to be inserted into manifold 2. With nozzle inserted part way into manifold cavity 76, valve 65 is opened to allow high pressure water to enter nozzle 69 and exit through reverse direction orifices 70. The force of the high pressure water will cause nozzle 69 and its attached hose 67 to travel upward into manifold cavity 76 cutting scale from the interior surface 72 of manifold 2 and blowing cuttings out of manifold 2 at the position that valve means 64 has been pivoted or rolled-out from manifold 2. To prevent the removed scale from falling into that section 79 of the manifold cavity 76 located below opening 80 created by pivoting valve means 64, a shield means 81 is positioned over the top of section 79 to block the removed scale from falling into cavity section 79.

To unplug and clean headers 6 and hose 7 a hollow rigid tube 73 is attached to flexible hose end 74 and nozzle 69 is attached to the opposite end 75 of tube 73. In a preferred embodiment tube 73 will be of length greater than that of the combined length of header 6 and hose 7 so that it can be inserted through both and into manifold 2. As before cooling fluid circulation through manifold 2 is stopped. Hose 7 is disconnected from coil 8. Nozzle 69 is attached to tube 73 which in turn is attached to hose 67. Nozzle 69 is then inserted through hose 7 and header 6 and into manifold 2. The foot operated valve 65 is opened to allow is high pressure water to pass through hose 67, tube 73, nozzle 69 and then out through reverse direction orifices 70. The tube 73 with the high pressure water exiting through reverse direction orifices 70 is pulled back through header 6 and hose 7, Once tube 73 has been pulled back through hose 7 valve 65 is activated by the footoperated cut-off assembly 66 to cut off the high pressure water. This method results in scale and other matter which may have clogged header 6 or hose 7 being removed.

In an alternate embodiment headers 6 and hose 7 can be unplugged utilizing a forward direction nozzle 69 having orifices that direct the high pressure water forward and outward at an angle from nozzle 69 to cause the high pressure water to strike the interior wall surfaces 77 or 78 of the header 6 or hose 77, respectively. In this configuration valve means 64 should be pivoted or rolled out so that any scale or other matter removed from headers 6 and hoses 7 can be trapped and removed from manifold cavity 76 through the opening 77 created by the rolled out valve means 64.

It has been found that water pressure of 5,000 to 7,000 psig in conjunction with orifice sizes of about 0.031 to 0.078 inches in diameter will be sufficient to remove the scale and other material from manifold wall surface 76, header wall surfaces 77 and hose wall surfaces 78.

There are of course other alternate embodiments which are obvious from the foregoing descriptions of the invention which are intended to be included within the scope of the invention as defined by the following claims.

What I claim is:

1. A method of cleaning a nitric acid absorption column having a coil which has multiple 180° bends and is provided with an access port and an exit port, having a cooling fluid supply manifold header and header hose, and having a cooling fluid return manifold header and header hose, which comprises:

(a) cleaning the coil by:
  (i) inserting a pig through the access port and into the coil,
  (ii) maintaining pressure by a fluid pump on the pig sufficient to force the pig through said coil, and
  (iii) capturing the pig after it passes through the exit port; and (b) cleaning the cooling fluid supply manifold headers and header hoses and the cooling fluid return manifold headers and header hoses of an absorption column by:
  (i) operatively connecting a valve means to a high pressure fluid supply to control the amount of fluid flowing through the valve means and into a flexible hose which has been operatively connected to the valve means to receive the high pressure water,
  (ii) operatively attaching a hollow tube having a nozzle provided with reverse direction orifices and of a length greater than the length of the manifold header and the header hose, to the opposite end of the flexible hose to receive the high pressure water from the flexible hose and to allow the high pressure water to exit from the reverse direction orifices,
  (iii) inserting the nozzle into the header nipple of the header hose until it emerges into the manifold,
  (iv) opening the valve means to allow high pressure water to flow out the reverse direction orifices, and
  (v) pulling the nozzle out of the header or header hose.

2. A method according to claim 1 wherein said method further comprises the steps of:

(a) closing the exit port;
(b) operatively attaching a means to the access port to allow fluid to be pumped through the access port and into the coil;
(c) closing the access port;
(d) measuring the pressure in the coil to determine if any drop in the pressure occurs; and
(e) then opening the exit port.

3. A method according to claim 1 wherein said pressure is 50–100 psig.

4. A method according to claim 1 further comprising opening a pressure relief valve operatively connected to the coil when the pressure within the coil exceeds 400 psig.

5. A method according to claim 1 wherein the pig comprises:

(a) a substantially, cylindrical-shaped body constructed of compressible material, wherein one end of the body is conicallyshaped and whose diameter is about 1/16th of an inch longer than the inside diameter of the coil; and (b) a band of wire brush spirally wrapped about a portion of the body.

6. A method according to claim 1 wherein the pressure of the high pressure water is 5000 to 7000 psig, and the reverse direction orifices are 0.031 to 0.078 inches in diameter.

7. A method according to claim 1 wherein the nitric acid absorption column is provided with one or more coils containing restrictions caused by acid-soluble scale buildup, and wherein prior to inserting the pig into the coil:

(a) connecting the access ports and the exit ports with hosing section to form a single passageway through the coils;

(b) operatively connecting one of the exit ports to a source of acid capable of dissolving the scale buildup;

(c) operatively connecting one of the access ports to the source;

(d) utilizing pumping means to circulate the acid from the source to the connected access port, then through the coils, then out the connected exit port, and then back to the source until sufficient amounts of the scale buildup have been dissolved and removed from the coils by the circulating acid to allow the pig to pass through the coils;

(e) disconnecting the exit ports and the access ports to allow fluid to flow through the coils in parallel.

8. A method of cleaning cooling fluid supply manifold headers and header hoses and the cooling fluid return manifold headers and header hoses of a nitric acid absorption column which comprises:

(a) operatively connecting a valve means to a high pressure fluid supply to control the amount of fluid flowing through the valve means and into a flexible hose which has been operatively connected to the valve means to receive the high pressure water, (b) operatively attaching a hollow tube having a nozzle provided with reverse direction orifices and of a length greater than the length of the manifold header and the header hose, to the opposite end of the flexible hose to receive the high pressure water from the flexible hose and to allow the high pressure water to exit from the reverse direction orifices, (c) inserting the nozzle into the header nipple of the header hose until it emerges into the manifold, (d) opening the valve means to allow high pressure water to flow out the reverse direction orifices, and (e) pulling the nozzle out of the header or header hose.

9. A method according to claim 8 wherein the pressure of the high pressure water is 5000 to 7000 psig, and the reverse direction orifices are 0.031 to 0.078 inches in diameter.

10. A method for cleaning a vertically oriented nitric acid absorption column cooling fluid manifold having valve means for controlling the flow of cooling fluid through the manifold which comprises:

(a) stopping the flow of the cooling fluid through the manifold;

(b) removing the valve means to create an opening into the cavity of the manifold;

(c) inserting a nozzle of a cleaning apparatus comprising a flexible hose, a nozzle having reverse direction orifices operatively attached to the flexible hose to allow high pressure water to pass from the flexible hose and exit through the orifices, and a valve means operatively attached to the opposite end of the flexible hose to control the amount of water passing through the flexible hose and operatively attachable to a high pressure water supply;

(d) opening the valve to allow sufficient high pressure water to flow from the reverse direction orifices to cause the nozzle to travel vertically into the cavity and to remove scale from the interior surface of the walls forming the cavity; and (e) blocking the cavity below the opening to cause any scale removed by the action of the high pressure water to flow out of the opening.

* * * * *